US009637995B2

(12) United States Patent
Ayling

(10) Patent No.: US 9,637,995 B2
(45) Date of Patent: May 2, 2017

(54) DRILLING APPARATUS WITH CONTINUOUS ROTATION WHILE TUBULAR IS BEING ADDED

(76) Inventor: Laurence John Ayling, Sneem (IE)

( * ) Notice: Subject to any disclaimer, the term of this patent is extended or adjusted under 35 U.S.C. 154(b) by 448 days.

(21) Appl. No.: 14/127,140

(22) PCT Filed: Jun. 22, 2012

(86) PCT No.: PCT/IE2012/000031

§ 371 (c)(1),
(2), (4) Date: Dec. 17, 2013

(87) PCT Pub. No.: WO2012/176182

PCT Pub. Date: Dec. 27, 2012

(65) Prior Publication Data

US 2014/0124267 A1 May 8, 2014

(30) Foreign Application Priority Data

Jun. 23, 2011 (IE) ..... 2011/0293

(51) Int. Cl.
*E21B 19/16* (2006.01)
*E21B 33/068* (2006.01)
*E21B 21/01* (2006.01)

(52) U.S. Cl.
CPC ..... *E21B 33/068* (2013.01); *E21B 19/16* (2013.01); *E21B 19/161* (2013.01); *E21B 21/01* (2013.01)

(58) Field of Classification Search
USPC ..... 175/40, 57, 207
See application file for complete search history.

(56) References Cited

U.S. PATENT DOCUMENTS 2,585,995 A * 2/1952 Brown ..... E21B 17/07 175/318
5,476,148 A * 12/1995 LaBonte ..... E21B 19/08 175/27
6,315,051 B1 11/2001 Ayling
6,688,394 B1 2/2004 Ayling
(Continued)

FOREIGN PATENT DOCUMENTS

GB 2399112 A 9/2004
GB 2466568 A 6/2010
(Continued)

OTHER PUBLICATIONS

International Search Report; PCT/IE2012/000031; Feb. 14, 2014.
International Preliminary Report on Patentability; PCT/IE2012/000031; Feb. 18, 2014.

*Primary Examiner* — Taras P Bemko
(74) *Attorney, Agent, or Firm* — Studebaker & Brackett PC

(57) ABSTRACT

A drilling apparatus (1) provides continuous rotation, and in some embodiments also vertical translation of the drill bit, such that weight can be kept on the bit and drilling can continue uninterrupted during connections. The connection is made in a pressure chamber formed by seals (2, 4) and spacers (15, 16). An upper snubber (5) grips the drill string above the joint and a lower snubber (6) grips it below the joint. The top drive is decoupled as the snubbers take over drill string drive, and apply a differential torque so that the connection is made. This achieves continuous rotation during the connection, and by use of an extension sub (18) drilling is also continuous.

16 Claims, 3 Drawing Sheets

(56) References Cited

U.S. PATENT DOCUMENTS

| | | | |
|---|---|---|---|
| 7,107,875 | B2 | 9/2006 | Haugen et al. |
| 7,252,161 | B2 | 8/2007 | Ayling |
| 7,726,418 | B2 | 6/2010 | Ayling |
| 8,033,338 | B2 | 10/2011 | Springett |
| 8,590,640 | B2 | 11/2013 | Haughom |
| 2010/0155143 | A1 | 6/2010 | Braddick |

FOREIGN PATENT DOCUMENTS

| | | | |
|---|---|---|---|
| WO | 00/22278 | A1 | 4/2000 |
| WO | 02/36928 | A1 | 5/2002 |
| WO | 03/004827 | A1 | 1/2003 |
| WO | 2005/012685 | A1 | 2/2005 |
| WO | 2005/019596 | A1 | 3/2005 |
| WO | 2009/022914 | A1 | 2/2009 |
| WO | 2009/093069 | A1 | 7/2009 |

* cited by examiner

DRILLING APPARATUS WITH CONTINUOUS ROTATION WHILE TUBULAR IS BEING ADDED

INTRODUCTION

Field of the Invention

The present invention relates to a method and apparatus for drilling.

It is well known in the drilling industry, and particularly in the field of drilling for hydrocarbons, that, when drilling with rotary drilling rigs using drill strings comprised of a large number of tubular pipe sections referred to hereinafter as "tubulars", the drilling operation has to be stopped every time that a tubular, or stand of two or more tubulars, has to be added to the drill string.

Each time that a tubular is added it is necessary to stop the drilling operation, to allow the drill string to be disconnected and a new tubular or stand of tubulars to be added. These interruptions to the drilling operation are costly but, more importantly, downhole, the fluid dynamic regime of flows and pressures that has been established during drilling is significantly upset and the steady state established during drilling is lost.

Prior Art Discussion

The following lists the typical problems which arise with stop/starts of the drilling operation every time a drill string connection is made:

| List A | List B |
|---|---|
| Surging on stop/start circulation | Formation Fracturing |
| Formation pumping & Ballooning | Lost circulation |
| ECD variations | Differential Sticking |
| Well de-stabilisation in UBD | Stuck Pipe |
| Static Cuttings Settlement | Slugging of Cuttings Returns |
| Connection Kicks | Narrow Pore/Frac pressure windows |
| Disconnecting mud from drill string | Lengths of sections in ERD wells |
| Pressure and temperature variations in HPHT wells | Bit wear/ROP/Surge & swab |

In order to eliminate the problems in List A, and/or minimise the problems in List B, apparatus and methods have been devised, as described in U.S. Pat. No. 6,688,394 and U.S. Pat. No. 6,315,051. This describes a "continuous circulation system" (CCS) to add or remove tubulars while continuing to circulate mud down the drill string and thus maintain a steady downhole pressure, flow regime, ECD (Equivalent Circulating Density), cuttings mobility, mud temperatures and properties, and loading of the pumps and shakers. Further developments are described in WO00/22278, WO02/36928, and WO03/004827.

An alternative method and apparatus is described in WO2005/019596, which describes a "continuous circulation valve or diverter sub" (CCV).

GB2399112 and WO2005/019596 describe developments in adding tubulars. GB2466568, WO2009/022914, and WO2009093069 describe developments in mud circulation. The contents of all of these documents are incorporated herein by reference.

The invention is directed towards achieving further improvements in addressing the problems listed in List A and List B above.

Glossary of Drilling Abbreviations

ECD Equivalent Circulating Density
UBD Under Balanced Drilling
HPHT High Pressure High Temperature ROP Rate of Penetration
CCS Continuous Circulating System
CCV Continuous Circulating valve
CDM Continuous Drilling Machine

SUMMARY OF THE INVENTION

According to the invention there is provided a drilling apparatus for allowing continuous circulation of mud while adding or removing tubulars from a drill string during the drilling of a well, the apparatus comprising: a snubber, a pressure chamber located beneath the snubber and comprising seals, a blind ram and a mud inlet and outlet, and a drill string drive beneath the pressure chamber.

wherein:

said snubber is an upper snubber and is adapted to apply sufficient torque to a rotating tubular to make or break tool joint connections, and the apparatus comprises a drill string drive below the pressure chamber, said drive being adapted to apply torque and support to a rotating drill string during said connections.

In another aspect, the invention provides a method of adding a tubular at a tool joint of a drilling apparatus as described in any embodiment, the method comprising the steps of:

the snubber and the drill string drive gripping tubulars above and below a tool joint, the pressure chamber being sealed;

the drill string drive taking over drive of the drill string;

pressurising the chamber;

the snubber and the drill string drive breaking the tool joint connection due to differential torque between the snubber and the drill string drive while they are gripping the tubulars above and below the tool joint, and spinning out the tool joint;

the snubber stopping rotating and raising the tubular;

making a middle seal between the separated tubulars, and venting mud above the middle seal;

the snubber releasing the tubular which it was gripping;

accepting a new tubular;

closing the upper seal, pressurising the chamber above the middle seal, releasing the middle seal; and the snubber lowering the new tubular, and spinning it into a lower tubular to make a connection by differential torquing of the snubber and the drill string drive.

In one embodiment, the snubber drive and the drill string drive are interconnected.

In one embodiment, the drives are interconnected by a differential power train.

In one embodiment, the differential gear mechanism comprises a coupler allowing decoupling of the drives.

In one embodiment, the differential gear mechanism comprises intermeshed bevel gears linking input and output drive shafts with the remainder of the mechanism.

In one embodiment, the apparatus enables the drill string to be rotated by the drill string drive while a tool joint is disconnected or connected.

In one embodiment, the apparatus enables the drill string to be rotated by the drill string drive while tool joint connections are being made as well as when the said tool joint is disconnected or connected.

In one embodiment, the apparatus is adapted to be raised by an hydraulic drive to reach a next tool joint to be disconnected, and to then take over the rotation and support of the drill string from the top drive.

In one embodiment, the drive is adapted to support the drill string and to apply a desired bit weight to continue drilling during connections by adjusting vertical height of the apparatus. Preferably, the apparatus comprises a load cell, and a processor arranged to receive signals from the load cell and to adjust the height of the apparatus relative to a borehole and so maintain the desired weight on the drill bit for continuous drilling. In one embodiment, the controller is adapted to generate an output and/or a control signal to effect change in the extent of support to the drill string applied by the drill string drive.

In one embodiment, the apparatus comprises an extension sub arranged to allow the drill string to extend as drilling continues during connections.

In one embodiment, the extension sub is adapted to be included in a drill string close to a drill string neutral point, without tension or compression. In one embodiment, the extension sub comprises splined telescopic shafts.

In one embodiment, the extension sub comprises a spring or springs to adjust the tension or compression at which the extension sub will begin to extend.

In one embodiment, the extension sub is pressure balanced to operate independently of the internal and/or external fluid pressures.

In one embodiment, the apparatus body is adapted to be fixed to a rig floor, rig mast or derrick in a manner to restrain the apparatus from turning while resisting torque applied to rotate the drill string.

Preferably, the drill string drive is a power driven rotary table using slips or a gripping system.

In one embodiment, the drill string drive is a snubber.

In one embodiment, the power driven rotary table is capable of being raised to find the next tool joint to be disconnected In one embodiment, the lower snubber is installed upside-down and with a drive having the principle of a rotary table drive.

In one embodiment, the apparatus is adapted to provide continuous drilling in a steady fluid dynamic state downhole, whereby the operator or a processor can more easily, speedily and safely detect and/or diagnose and/or respond to downhole flow and pressure changes.

In one embodiment, the apparatus is adapted to maintain a steady fluid dynamic state downhole throughout the drilling of each section and so minimises or eliminates several typical drilling problems.

In one embodiment, the apparatus is adapted to allow tool joint connections, continuous circulation and rotation, or continuous drilling to be carried out without the presence of personnel on the rig floor and so increase safety.

DETAILED DESCRIPTION OF THE INVENTION

Brief Description of the Drawings

The invention will be more clearly understood from the following description of some embodiments thereof, given by way of example only with reference to the accompanying drawings in which.

The present invention provides a drilling apparatus sometimes referred to in this specification as a "continuous drilling machine" ("CDM"), which incorporates elements of the "CCS" system described in the above references. The prior art CCS elements allow continuous circulation of mud while adding or removing tubulars from a drill string during the drilling of a well.

In various embodiments, the system of the invention also includes continuous rotation, and in some embodiments also vertical translation of the drill bit, such that weight can be kept on the bit and drilling can continue uninterrupted during connections. We expect that this will not only eliminate the problems in List A but further significantly minimise the problems in List B above. The invention we expect will save the connection times in drilling and maintain a steady state downhole regime, for which continuous rotation and continuous drilling is essential. Furthermore, it is known that drill strings and bottom hole assemblies tend to stick to the wall of the uncased hole if rotation is stopped for any significant time, due to what is known as differential sticking. This steady state will also enable the driller to detect small changes in downhole flow and pressure more easily and earlier, diagnose and identify the cause more decisively, and respond faster than was previously possible, thus improving well control and increasing safety.

Figure 1:
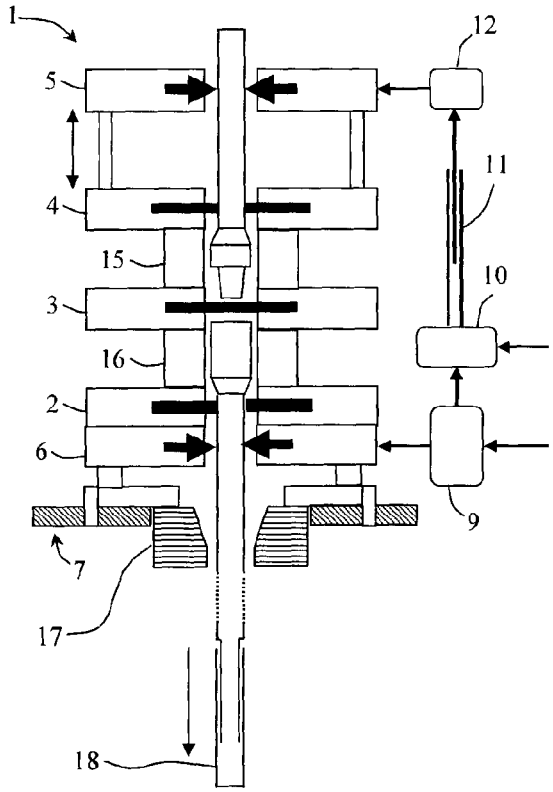
FIG. 1 is a cross section elevational view of a continuous drilling machine or apparatus of the invention in use with a tool joint disconnected and an extension sub in the drill string to achieve continuous drilling.
Figure 2:
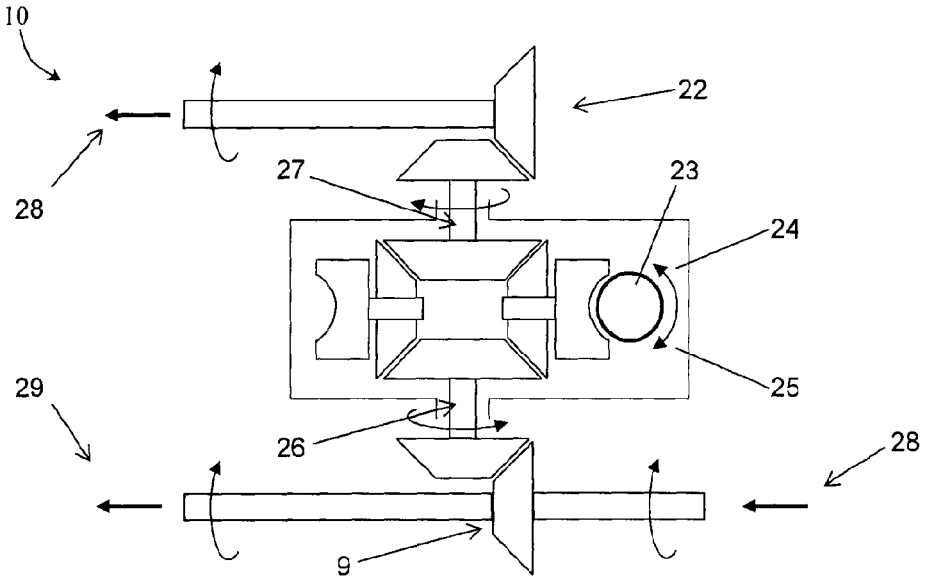
FIG. 2 shows schematically a preferred differential gear box of the system.

Referring to FIGS. 1 and 2, in one embodiment, an apparatus 1 comprises a pressure chamber and snubber assembly with a lower seal 2, a blind ram 3, an upper seal 4, a snubber 5, and short spacers 15 and 16. The seals can be either ram or rotary. In this invention however, the upper snubber is required to break out or torque up connections while the tool joint is rotating. The spacers 15 and 16 can be short because, there is no need for long tool joint upsets.

The apparatus 1 also includes a gripping mechanism or lower snubber 6 below and connected to the pressure chamber and upper snubber 5 above. The lower snubber 6 supports the drill string and rotates it in full drilling mode, and is supported and fixed to the rig floor 7 to allow it to move vertically if required, but not rotate. It may be an upside down version of the upper snubber 5 with both snubbers directly or indirectly supported by and fixed to the rig floor 7 in such as way that either snubber body may be moved vertically but neither can rotate.

FIG. 1 also shows a rotary table 17 and an extension sub 18. The latter is splined and telescopic for automatic lengthening so that weight on the bit is maintained as it drills ahead and continuous drilling is achieved. The extension sub 18 may comprise—springs or hydraulics to set the tension or compression force at which the extension sub 18 will extend as the bit continues to drill ahead. Also, it may comprise one or more extendable units or bumper subs or modified jars in series to facilitate a total extension of approximately 3 m to 5 m, depending on the formation to be drilled and the expected total connection times. Also it may be pressure balanced to be unaffected by the circulating mud pressure. The extension sub may for example be of the type marketed by Schlumberger under the term "bumper sub".

The extension subs of this embodiment are telescopic so that they extend and contract according to applied pressure, but are splined together to rotate and transfer torque.

The snubbers 5 and 6 require drives to rotate the internal gripping mechanisms and these can conveniently be electrical or hydraulic and facilitate the transmission of high torques to achieve the tool joint connection break outs and torquing up. One approach is to transfer power 8 to a gear box 9 to drive both snubbers 5 and 6, the upper snubber being driven via a differential gear box 10, an extendable drive shaft 11, and a gear box 12.

FIG. 2 shows the preferred differential gear box 10 with an input drive 26, and an output drive 27 and has a third rotary drive 23 which adjusts the relationship between the rotations of the two snubbers 5 and 6 via drives at 28 and 29.

Figure 7:
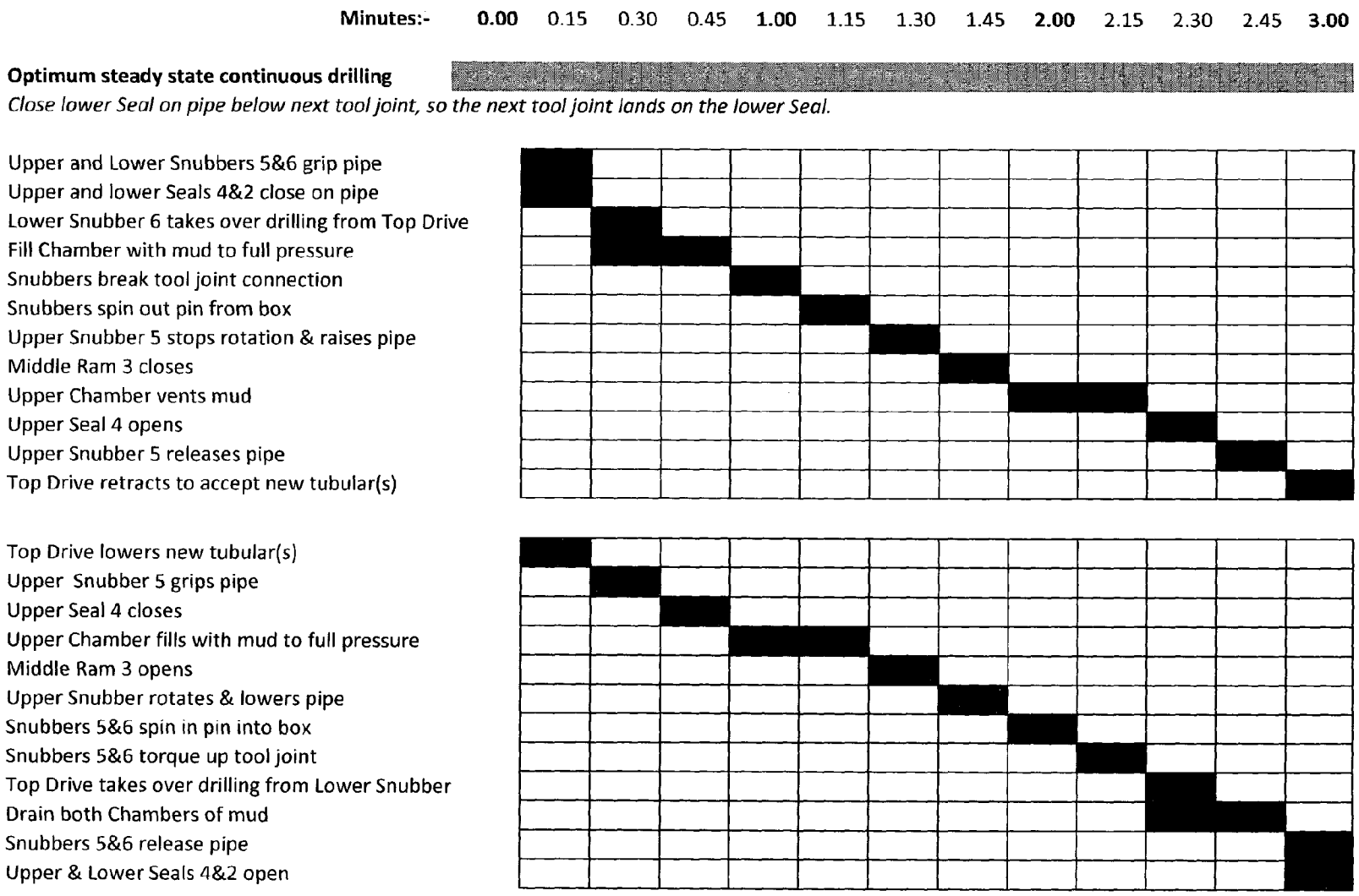
FIG. 7 is a flow diagram and time chart illustrating the steps for making connections and the time scales involved, in which the top half deals with disconnection and the bottom half deals with making a connection.

In use, the procedure for adding a tubular while achieving both continuous rotation and continuous drilling using the apparatus 1 is scheduled in FIG. 7. This shows the expected durations, during which the bit drills ahead and the extension sub or the lowering of the apparatus within the drilling rig allows the drill bit to penetrate the formation.

It will be seen from this diagram that the snubbers 5 and 6 grip the tubulars and the seals 2 and 4 seal above and below the proposed joint by closing on the tubulars. The lower snubber 6 then takes over from the top drive, and the chamber is pressurised. The snubbers 5 and 6 then break the tool joint connection by applying a differential torque between the snubbers. This is achieved by rotation of the shaft 23, which controls the rotary relationship between the snubbers. The upper snubber 5 then stops rotating and raises the tubular (or "pipe"), following which the middle ram 3 closes to define a separate upper chamber, from which the mud is then vented. When the upper seal 4 opens, the upper snubber 5 releases the tubular (which is the top drive sub in the drilling process). The top drive then retracts (along with it top drive sub tubular which the upper snubber has released) to be in a position to accept a new tubular.

Then, some time later, the top drive lowers a new tubular or multiple tubulars, which are then gripped by the snubber 5. The upper seal 4 closes, allowing the upper chamber to be pressurised. On retraction of the middle ram 3 the chambers become one again, and the upper snubber 5 rotates and lowers the new tubular, The top tubular is spun into the lower one, referred to as a pin spinning into a box. By differential rotation of the snubbers the tool joint is torqued up and the top drive can take over, and both seals and both snubbers can open.

While the tool joint is connected and drill string is being rotated by the lower snubber 6, the torque passing through the differential gearbox 10 is small. While the tool joint connection is disconnected and the drill string is rotating, the torque passing through the differential gear box 10 is also small. The differential gearbox 10 allows the shaft 23 to alter the rotary relationship between the two snubbers 5 and 6; to apply a breaking or making torque or to spin the tool joint pin out of, or into, the tool joint box.

When the shaft 23 is turned one way (arrow direction 24, anti-clockwise as viewed in FIG. 2), the tool joint connection can be broken and spun out; when the shaft 23 is turned the other way (25), the tool joint connection can be spun in and torqued up. When the shaft 23 is not turned, the rotational speeds of the upper and lower snubbers 5 and 6 are the same. When the shaft 23 is allowed to free wheel the rotation of the upper snubber may be stopped. Thus the torque and turns put into the shaft 13 can be directly and reliably related to the disconnection and connection of the tool joint.

In general, the system of the invention comprises a body which attaches to a drill floor, or rig mast, or derrick, or any other convenient support. There is a top drive, a snubber below the top drive, and a pressure chamber beneath the snubber and comprising seals, a mud inlet and outlet, and means to separate the pressure chamber into upper and lower parts. The upper snubber is adapted to apply torque to a rotating tubular above a joint within the pressure chamber. There is a second, lower, drive below the pressure chamber, to apply torque to a rotating drill string below the joint. The apparatus may comprise a drive train between the snubber and the lower drill string drive to allow tool joints to be broken or torqued up while the drill string is being driven and supported by the lower snubber. Importantly, there is a differential torque applied above and below the joint, so that the joint may be disconnected while the drill string still rotates, and due to the extension sub there is also continuous drilling in the FIG. 1 embodiment When a tool joint in the drill string above the drill floor is to be disconnected to add another tubular or stand of tubulars, the apparatus seals against the drill string below and above the tool joint and, preferably while the chamber is filling with mud. The lower and upper snubbers (which are preferably rotating at the same speed as the top drive) engage the drill string with the drill string still being rotated by the top drive.

The lower drive (which may be a lower snubber) below the pressure chamber then takes over from the top drive the functions of supporting the drill string and providing the drill string with drilling torque; so that there is then no torque or tension being transmitted by the tool joint and the upper snubber is idling with the lower snubber driving the drill string. The upper snubber provides a rotating drive that is capable of transmitting the high torques necessary for breaking connections or torquing up connections, while rotating.

The breaking out of connections or torquing up of connections as well as the spinning out or spinning in of the pin from or into the box, is conveniently achieved by using a differential torquing system, which transmits the specific torque required between the gripping mechanisms of the upper snubber and lower drive, while continuing to rotate the drill string.

The lower drive is designed to apply a constant drill string torque to the drill bit even when the tool joint above is being broken out or torqued up, preferably by employing a constant rotation speed control of the lower drive during connections, to isolate the drilling torque from the differential torques taking place between the top snubber and the lower drive.

Both the upper snubber and the lower drive can be rotated at the same speed as the top drive before engaging the drill string in order to minimise wear on the tubulars and the differential drive can be operated in such a way as to allow the upper snubber to cease rotation as soon as the tool joint is disconnected.

During connections, the whole assembly can move downwards, to maintain the desired weight on the drilling bit, as the bit continues to drill into the formation. In this case one or more load cells or similar force measurement devices placed beneath the assembly can control the downward movement of the assembly to maintain a constant bit weight.

Alternatively, the whole assembly is mounted on the rig floor without the need for vertical movement and an extendable sub is installed in the drill string at or near the neutral point between tension and compression, such that the extendable sub is collapsed during drilling but extends to allow the bit to drill on and penetrate the formation by several feet while connections are made on the drill floor. Such an extendable sub being able to transmit torque and preferably being pressure balanced with or without additional springs, to remain collapsed despite high internal mud pressures—Such an extendable sub operates on a similar principle to that used in early floating drilling and known in the industry as a "bumper-sub" though the extendable principle is now more commonly used in "jars" used to unstick stuck pipe. Currently available extendable subs can be increased in extension to several meters; and two or more may be used in series to facilitate sufficient extension during connections, when anticipating soft formations with higher ROPs (Rates of Penetration).

When the apparatus has completed a connection, the top drive takes over the drillstring rotation and support from the apparatus, and the apparatus can be withdrawn from contact with the drill string. Between connections, the apparatus is not required to operate and can be inspected and adjusted without affecting the drilling operation.

The apparatus therefore allows drilling to be continuous and the downhole fluid dynamics to be steady state through connections and throughout the drilling of each section. Since drilling continues during connections, there is no time difference if singles, doubles, or triples are used during drilling. When tripping out or into the hole, the vertical motion of the drill string is stopped for each disconnection or connection respectively with the apparatus (CDM) resting at its lowest position on the rig floor.

Circulation and rotation of the drill string may be continuous during tripping out or in, at whatever level of circulation and rotation desired and 'flow managed' to reduce surge and swab. The circulation may be increased steadily to compensate for reducing ECD (equivalent circulating density) and an annular mud pressure may be applied as the bottom hole assembly is removed from the hole, to maintain downhole pressure. This may be achieved by using an RCH (Rotary Control Head) on the annulus and simply throttling the continuous circulation.

The height of the apparatus, when retrofitted onto some rigs, may only allow doubles (not triples) to be used in normal drilling but this will only affect the tripping time, not the drilling time. However, if an extendable sub is used in the drill string, the assembly may be adequately compact to allow the use of triples on most rigs. Or, if an extendable sub is used and the lower drive is a rotary table and adapted to apply the required drilling torque driven by the said differential system, the height of the apparatus may be further minimised. If the length of tool joint upsets is reduced, the height of the apparatus may be still further reduced to assuredly accommodate triples.

When the apparatus is used as a matter of common practice, there will no longer be a need for long tool joint upsets. Short tool joint upsets will not only reduce the height of the apparatus to assuredly accommodate triples, but the lower drill string "rigidity" will reduce tubular stresses when building angle on deviated wells.

Figure 3:
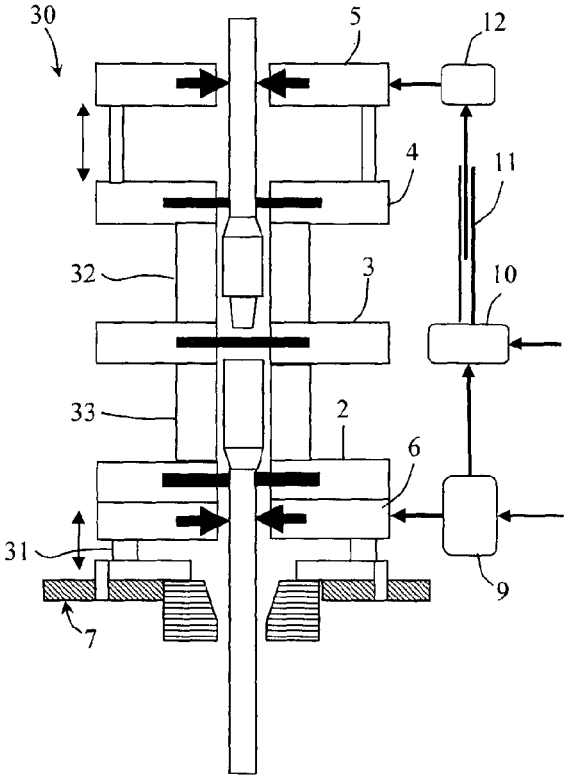
FIG. 3 shows an apparatus, without an extension sub in the drill string, in which an hydraulic system is used to lower the machine to maintain weight on the bit and to achieve continuous drilling.

In FIG. 3 an apparatus 30 has an hydraulic support system 31 for varying height of the apparatus in order to maintain bit weight for continuous drilling. Also, in this case longer spacers 32 and 33 are shown, which are typical of those normally used in the industry (up to 500 mm each).

In place of the lower snubber, a power driven rotary table in the rig floor may be used and, if so, the apparatus may further comprise a drive train between the upper snubber and the rotary table to allow tool joints to be broken or torqued up while the drill string is being driven by the rotary table.

Figure 4:
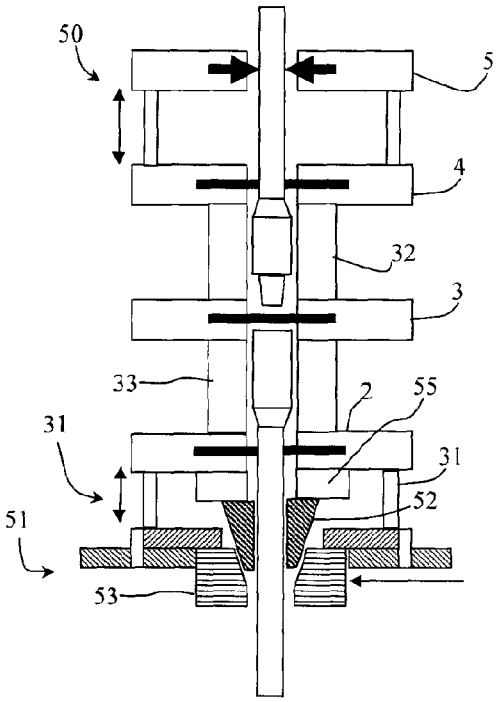
FIG. 4 shows an apparatus in which the lower drive is provided using a motorised rotary table and slips instead of a snubber, and the upper and lower drives are not interconnected, facilitating rotation of the drill string when and while the tool joint is disconnected.

In an apparatus 50 shown in FIG. 4 the lower drive comprises a driven rotary table 51 with rotary slips 52 set in a motorised rotary table "bowl" 53. A bearing 55 allows mutual rotation between the rotary table 51 and the assembly above. Again, there is an hydraulic system 31 for lifting to set the slips 52. This does not achieve continuous drilling, but does achieve rotation when the tool joint is disconnected.

Figure 5:
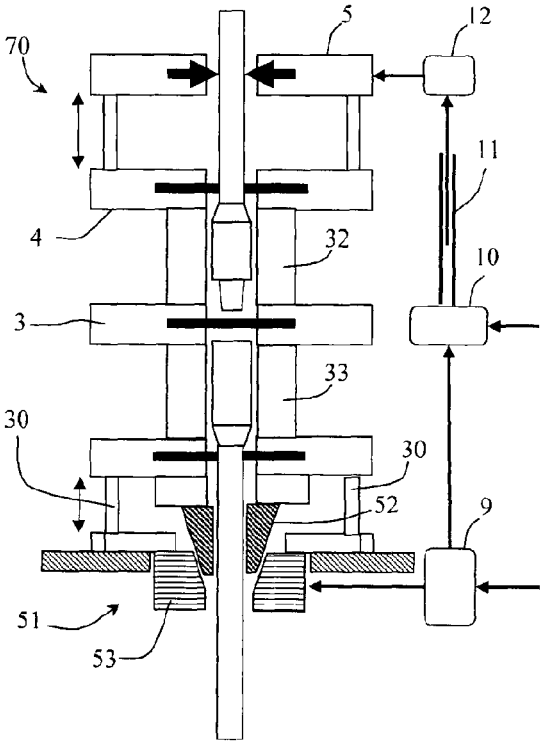
FIG. 5 shows an apparatus in which the upper and lower drives are interconnected, and the lower drive is via a motorised rotary table and slips, to achieve continuous rotation.

In FIG. 5 an apparatus 70 also has a lower drive provided by the motorised rotary table 51. In this case the top snubber 5 and the driven rotary table 51 are driven by the same differential drive as is shown in FIG. 1. This achieves continuous rotation, but not continuous drilling because the drill string is set in the slips 52.

Figure 6:
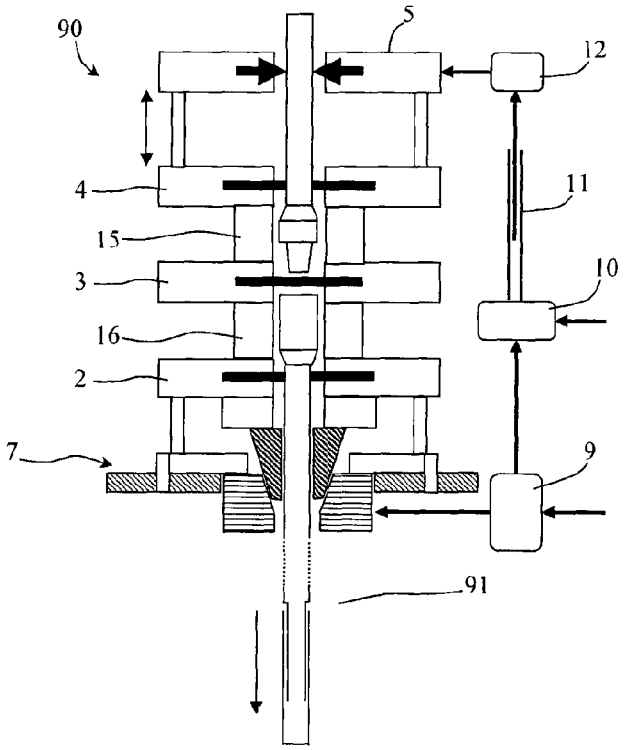
FIG. 6 shows a variation of the apparatus of FIG. 5 in which continuous drilling is additionally achieved by use of an extension sub in the drill string.

In FIG. 6 an apparatus 90 is similar to the apparatus 70, except that continuous drilling is achieved by use of an extension sub 91.

It will be appreciated from the above that the weight of the drill string can be taken either by the slips in the rotary table or the lower drive and/or the tool joint upset can be landed on the lower sealing ram of the pressure vessel above. Also the tool joint upsets (pin and/or box) are shortened to minimise the size, height and weight of the continuous circulation, continuous circulation and partial rotation, continuous circulation and rotation and/or continuous drilling machines. Where the apparatus provides continuous drilling in a steady fluid dynamic state downhole, the operator or a processor can more easily and speedily detect and/or diagnose and/or respond to downhole flow and pressure changes and hence improve well construction safety.

Also, the apparatus may provide continuous drilling in a steady fluid dynamic state downhole, whereby the operator or a processor can more easily drill through unstable formations without incurring drilling problems, and hence improve drilling efficiency and often be able to drill longer sections before having to case the hole.

The invention is remotely operated and allows one to provide an unmanned rig floor environment to increase personnel safety.

The invention is not limited to the embodiments described, but may be varied in construction and detail.

The invention claimed is:

1. A drilling apparatus for allowing continuous drilling with drill string rotation and vertical translation with circulation of mud while adding or removing tubulars from a drill string during the drilling of a well, the apparatus comprising:

an upper snubber and snubber drive adapted to apply sufficient torque to a rotating tubular to make or break tool joint connections, a pressure chamber located beneath the upper snubber and comprising seals, a blind ram and a mud inlet and outlet, and a drill string drive beneath the pressure chamber, adapted to apply torque and support to a rotating drill string during said connections and during said continuous drilling and when said tool joint is disconnected or connected, a differential drive train interconnecting said snubber drive and the drill string drive, said differential drive train decouples the drill string drive from the snubber drive, an extension sub adapted to automatically lengthen to allow vertical translation of a drill bit at the end of a drill string such that weight is kept on the drill bit and drilling continues uninterrupted during drill string connections, said extension sub comprising splined telescopic shafts and at least one spring or hydraulics to set tension or compression forces at which the extension sub begins to extend as the drill string continues to drill during drill string connections.

2. The drilling apparatus as claimed in claim 1, wherein the differential drive train comprises intermeshed bevel gears linking input and output drive shafts with the remainder of the mechanism.

3. The drilling apparatus as claimed in claim 1, wherein the apparatus is adapted to be raised by an hydraulic drive to reach a next tool joint to be disconnected, and to then take over the rotation and support of the drill string from the top drive.

4. The drilling apparatus as claimed in claim 1, wherein the drive is adapted to support the drill string and to apply a desired bit weight to continue drilling during connections by adjusting vertical height of the apparatus.

5. The drilling apparatus as claimed in claim 1, wherein the drive is adapted to support the drill string and to apply a desired bit weight to continue drilling during connections by adjusting vertical height of the apparatus; and wherein the apparatus comprises a load cell, and a processor arranged to receive signals from the load cell and to adjust the height of the apparatus relative to a borehole and so maintain the desired weight on the drill bit for continuous drilling.

6. The drilling apparatus as claimed in claim 1, wherein the extension sub is adapted to be included in the drill string close to a drill string neutral point, without tension or compression.

7. The drilling apparatus as claimed in claim 1, wherein the apparatus body is adapted to be fixed to a rig floor, rig mast or derrick in a manner to restrain the apparatus from turning while resisting torque applied to rotate the drill string.

8. The drilling apparatus as claimed in claim 1, wherein the drill string drive is a power driven rotary table using slips or a gripping system.

9. The drilling apparatus as claimed in claim 1, wherein the drill string drive is a snubber.

10. The drilling apparatus as claim 1, wherein the drill string drive is a snubber; and wherein the power driven rotary table is capable of being raised to find the next tool joint to be disconnected.

11. The drilling apparatus as claimed in claim 1, wherein the drill string drive is a snubber; and wherein the power driven rotary table is capable of being raised to find the next tool joint to be disconnected; and wherein the snubber is installed upside-down and with a drive having the principle of a rotary table drive.

12. The drilling apparatus as claimed in claim 1, wherein the apparatus is adapted to provide continuous drilling in a steady fluid dynamic state downhole, whereby the operator or a processor can more easily, speedily and safely detect and/or diagnose and/or respond to downhole flow and pressure changes.

13. The drilling apparatus as claimed in claim 1, wherein the apparatus is adapted to maintain a steady fluid dynamic state downhole throughout the drilling of each section and so minimises or eliminates several typical drilling problems.

14. The drilling apparatus as claimed in claim 1, wherein the apparatus is adapted to allow tool joint connections, continuous circulation and rotation, or continuous drilling to be carried out without the presence of personnel on the rig floor and so increase safety.

15. A method of adding the tubular at a tool joint of the drilling apparatus as claimed in claim 1, the method comprising the steps of:

the snubber drive and the drill string drive gripping tubulars above and below the tool joint, the pressure chamber being sealed;

the drill string drive taking over drive of the drill string;

pressurising the chamber;

the snubber drive and the drill string drive breaking the tool joint connection due to differential torque between the snubber and the drill string drive while they are gripping the tubulars above and below the tool joint, and spinning out the tool joint;

the snubber stopping rotating and raising the tubular;

making a middle seal between the separated tubulars, and venting mud above the middle seal;

the snubber releasing the tubular which it was gripping;

accepting a new tubular;

closing the upper seal, pressurising the chamber above the middle seal, releasing the middle seal; and the snubber lowering the new tubular, and spinning it into a lower tubular to make a connection by differential torquing of the snubber and the drill string drive, and in which the extension sub automatically lengthens to allow vertical translation of the drill bit at the end of the drill string such that weight is kept on the drill bit and drilling continues uninterrupted during drill string connections, in which at least one spring or hydraulics sets tension or compression forces at which the extension sub begins to extend as the drill string continues to drill during drill string connections.

16. A drilling apparatus for allowing continuous drilling with drill string rotation and vertical translation with circulation of mud while adding or removing tubulars from a drill string during the drilling of a well, the apparatus comprising:

an upper snubber and snubber drive adapted to apply sufficient torque to a rotating tubular to make or break tool joint connections, a pressure chamber located beneath the upper snubber and comprising seals, a blind ram and a mud inlet and outlet, and a drill string drive beneath the pressure chamber, adapted to apply torque and support to the rotating drill string during said connections and when a tool joint is disconnected or connected, a differential drive train interconnecting said snubber drive and the drill string drive, said differential drive train decouples the drill string drive from the snubber drive, an extension sub adapted to automatically lengthen to allow vertical translation of a drill bit at the end of a drill string such that weight is kept on the drill bit and drilling continues uninterrupted during drill string connections, said extension sub comprising splined telescopic shafts and at least one spring or hydraulics to set tension or compression forces at which the extension sub begins to extend as the drill string continues to drill during drill string connections, and wherein the drill string drive is adapted to support the drill string and to apply a desired bit weight to continue drilling during connections by adjusting a vertical height of the apparatus; and wherein the apparatus further comprises:

a load cell, and a processor arranged to receive signals from the load cell and to adjust the height of the apparatus relative to a borehole and to maintain the desired weight on the drill bit for continuous drilling; and to generate an output and/or a control signal to effect change in the extent of support to the drill string applied by the drill string drive.

* * * * *